US006062546A

United States Patent [19]

Gudmundsson

[11] Patent Number: 6,062,546

[45] Date of Patent: May 16, 2000

[54] METHOD AND DEVICE FOR TRANSFER OF MASS

[76] Inventor: Bjorn Gudmundsson, Porsvagen 120, Sollentuna, Sweden, S-19148

[21] Appl. No.: 09/017,149

[22] Filed: Feb. 2, 1998

Related U.S. Application Data

[60] Continuation of application No. 08/460,755, Jun. 2, 1995, abandoned, which is a division of application No. 08/137,040, Oct. 18, 1993, abandoned.

[30] Foreign Application Priority Data

Apr. 17, 1991 [SE] Sweden ..... 9101169
Apr. 16, 1992 [WO] WIPO ..... PCT/SE92/00254

[51] Int. Cl.[7] ..... B01F 3/04

[52] U.S. Cl. ..... 261/83; 261/84; 261/89

[58] Field of Search ..... 261/83, 84, 87, 261/89

[56] References Cited

U.S. PATENT DOCUMENTS

| | | | |
|---|---|---|---|
| 928,118 | 7/1909 | Fowler et al. | 261/89 |
| 1,050,013 | 1/1913 | Fowler et al. | 261/89 |
| 1,292,125 | 1/1919 | Stevens | 261/89 |
| 1,510,354 | 9/1924 | Turner | 261/84 |
| 1,888,872 | 11/1932 | D'Yarmett | 261/89 |
| 2,626,135 | 1/1953 | Serner | 261/84 |
| 3,273,865 | 9/1966 | White | 261/84 |
| 4,283,255 | 8/1981 | Ramshaw et al. | 261/89 |
| 4,399,794 | 8/1983 | Pilo | 261/89 |

FOREIGN PATENT DOCUMENTS

| | | | |
|---|---|---|---|
| 2000038 | 1/1979 | United Kingdom | 261/87 |

*Primary Examiner*—C. Scott Bushey
*Attorney, Agent, or Firm*—Dowell & Dowell, P.C.

[57] ABSTRACT

A method and apparatus for the transfer of mass with the aid of rotating surfaces. The fluid with which an exchange or transfer is to be made is introduced in parallel in one or more gaps or channels defined between the rotating surfaces. Rotation of the surfaces causes the major part of the fluid flow to pass through a rotating, flow mechanical boundary layer adjacent the rotating transfer surface in laminar or turbulent flow.

7 Claims, 3 Drawing Sheets

METHOD AND DEVICE FOR TRANSFER OF MASS

CROSS REFERENCE TO RELATED APPLICATIONS

This application is a continuation of application Ser. No. 08/460,755 filed Jun. 2, 1995, which is a divisional of application Ser. No. 08/137,040 filed Oct. 18, 1993, both entitled "Method and Device for Transfer of Heat or Mass" and both of which are now abandoned.

BACKGROUND OF THE INVENTION

1. Field of the Invention

The present invention relates to a method of transferring mass with the aid of rotating surfaces. The invention also relates to apparatus for carrying out the method.

2. History of Related Art

It is known to improve the transfer of heat between a fluid and a surface, by disturbing the flow adjacent the surface, this being achieved in the case of so-called flat plate-type heat exchangers by corrugating the transfer surfaces or by providing these surfaces with turbulence-generating means.

Although this will disturb or agitate the flow of medium adjacent the surfaces, it does not induce the fluid to flow adjacent to or contiguously with the surfaces, which would improve heat transfer, but instead the fluid remains in a stationary layer close to the heat transfer surfaces, this layer having an insulating effect on the heat transfer process.

Another method of improving heat transfer is to allow the fluid to flow through narrow confined passageways, such as in the case of rotating heat-exchangers, wherein the short distance between the fluid and the wall is utilized in an endeavor to improve heat transfer. One drawback with this solution is that the major part of the fluid passes through the center of the passageway or channel, despite the narrowness of the passageway, and thus plays a smaller role in the heat transfer process. Another drawback is that the narrow passageways are liable to become blocked, and it is often necessary to take measures to prevent blocking of the passageways, therewith making the system more expensive. In the two cases described above, the measures taken to improve heat or mass transfer involve attempting to force into being an effect which is opposed to the intrinsic will of the fluid flow to flow in a certain manner.

U.S. Pat. No. 4,044,824 teaches a method of exchanging heat between two fluid flows which are conducted in heat-exchange relationship with one another in a rotating heat exchanger having fluid-accommodating bellows-like pockets. The differences in the density occurring between the fluid to be cooled and the fluid to be heated is utilized to create turbulent conditions that are intended to promote the exchange of heat and the transportation of the fluids. One drawback with this known arrangement, however, is that the entire fluid flow is passed through one and the same channel out of and into the bellows-like pockets, which limits the capacity of the heat-exchanger and impairs its ability to transfer heat, since the major part of the fluid flow passes through the center of the channel or passageway, as described above.

GB-A-936,059 teaches a heat-exchange method and a heat-exchanger which is comprised of an outer element, an inner element and an intermediate element of bellows-like form, these three elements defining therebetween two channels for the pass through of media between which an exchange of heat takes place. This method and the illustrated heat-exchanger have the drawbacks mentioned above with respect to the aforesaid U.S. patent.

SUMMARY OF THE INVENTION

Distinct from the aforedescribed known methods and apparatus, the main object of the invention is to provide a method for mass transfer in which the transfer index or number is improved by utilizing the natural phenomenon of flow mechanics, without disturbing the fluid flow or forcing unnatural motion onto the flow. On the basis of this object, there is proposed a method for mass transfer in which very high transfer indexes or numbers are achieved.

Another object of the invention is to provide a mass transfer method in which the transfer performance can be adjusted readily to desired values.

A further object of the invention is to provide a mass transfer apparatus which is compact in relation to the transfer numbers or indexes obtained, since the heat and mass transfer is contingent on factors other than the size of the transfer surface.

These and other objects are achieved with the method and the apparatus having the characteristic features set forth in the following claims.

BRIEF DESCRIPTION OF THE DRAWINGS

The invention will now be described in more detail with reference to a number of exemplifying embodiments thereof and also with reference to the accompanying drawings, in which.

DESCRIPTION OF THE PREFERRED EMBODIMENT

Figure 1:
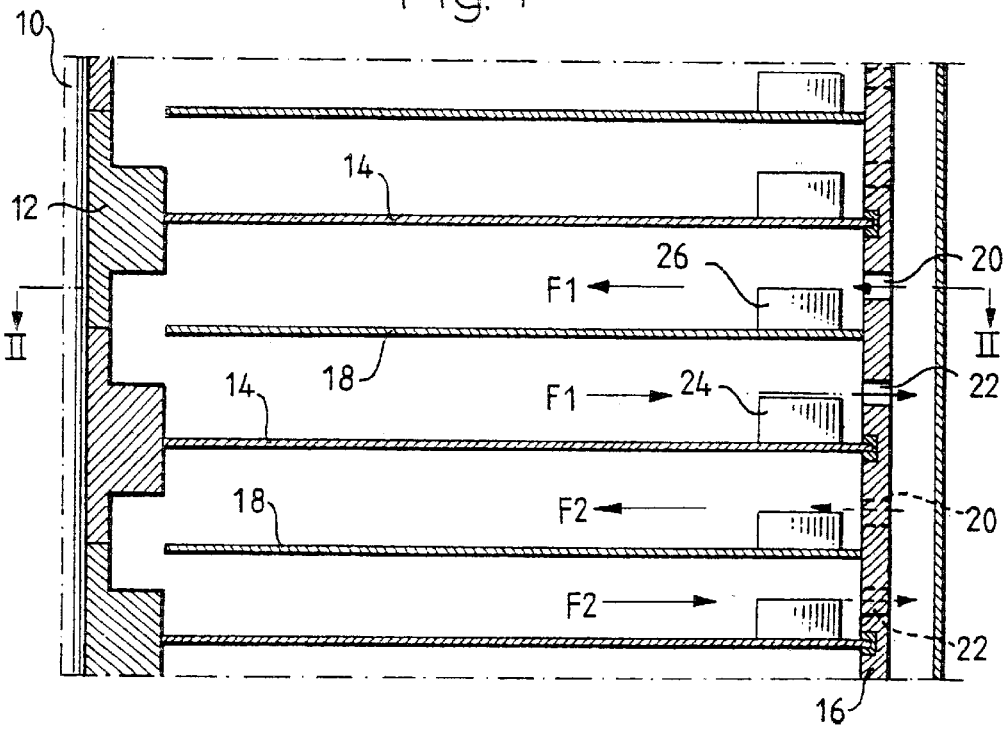
FIG. 1 is a sectional view of an apparatus for carrying out the method of the present invention.

The apparatus illustrated in FIG. 1 comprises a number of flat discs which are mounted on a rotation shaft 10 by means of sleeves 12 and which are intended to rotate together with the shaft 10 at appropriate speeds. The shaft 10 and the discs 14 rotate in a cylindrical housing whose outer wall 16 supports a number of planar discs 18 which are attached to the outer wall and which project in between the first mentioned discs 14 and terminate short of the shaft 10, so as to form an interspace between the ends of the discs 18 and the shaft 10. The free edges of the discs 14 mounted on the shaft 10 and fitted to the sleeves 12 extend into a respective recess provided in the wall 16. Arranged in the recess are labyrinth seals or, with regard to fluid seals, axial seals or the like for instance, which ensure that no leakage will occur between the discs 14 and the wall 16. Arranged alternately in the wall 16 are inlets 20 and outlets 22 for delivery of a fluid to the channel or passageway defined between two discs 14 and an intermediate disc 18. It will be seen that the channel extends from the inlet 20 to a respective recess defined between the sleeves 12 and back to the outlet 22. When two mutually different fluids F. and F. are delivered to the channels, and exchange or transfer takes place between the fluids, for instance a heat transfer, without the fluids intermixing.

In the case of the FIG. 1 embodiment, the inlets 20 and the outlets 22 may be located alternately in the apparatus hub and the housing wall. This arrangement will produce a counterflow effect between the fluids in which an interchange shall take place on each surface of the discs 14, 18.

By rotating the discs 14, 18 at different speeds, for instance by rotating the shaft 10 and therewith also the discs 14, an extremely efficient transfer is obtained when the greatest radial velocity component of the fluid is located in a boundary layer close to the disc surface. This rotation also generates a disc pumping effect, which can be amplified, however, by providing the disc 14 with blades 24 or vanes of appropriate configuration and angular placement, while the disc 18 may be provided with guide vanes 26. Naturally, it is also conceivable to rotate the housing wall 16 and the discs 18; the discs 14 and 18, however, may be rotated either at mutually different speeds or at mutually the same speed.

Figure 2:
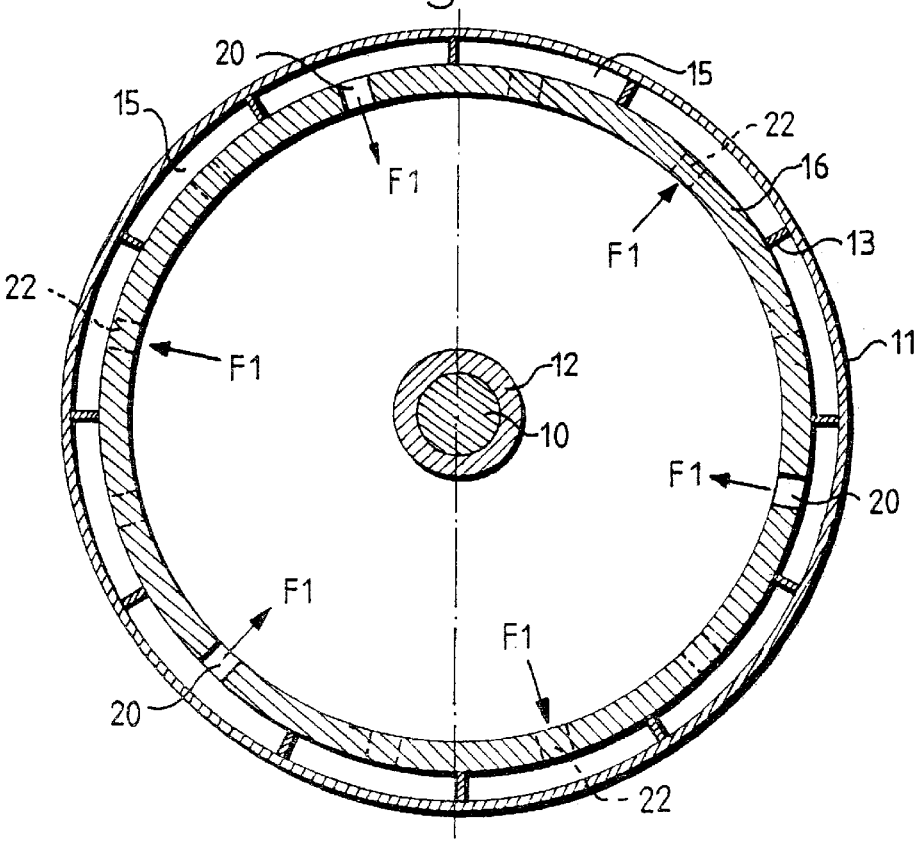
FIG. 2 is a sectional view of the apparatus shown in FIG. 1, taken on the line II—II.

FIG. 2 illustrates the delivery of the two fluids $F_1$ and $F_2$ to respective channels. Encircling the stationary housing 16 is a shell 11 which is divided by partition walls 13 into a number of riser channels 15 which form fluid inlets and outlets. In the case of the illustrated embodiment, three inlets 20 and three outlets 22 are connected with each disc-space between the discs 14, the inlets and outlets being uniformly distributed around the periphery of the apparatus so as to obtain an equal delivery of the fluid to the best possible extent. It will be understood that the number of inlets and outlets, and therewith the number of riser channels, can be varied as desired. FIG. 2 is a cross-sectional view through the entire apparatus, whereas FIG. 1 merely shows the right-hand half of the apparatus.

Figure 3:
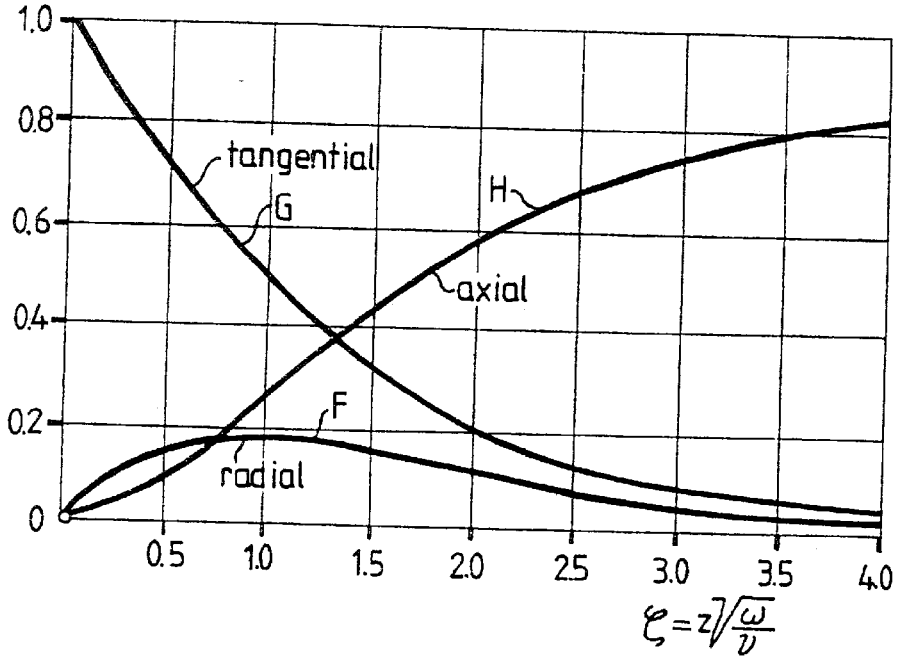
FIG. 3 illustrates the velocity distribution close to a disc which rotates in a stationary fluid.

FIG. 3 illustrates the flow mechanics of an infinite rotating disc in a fluid non-rotating far from the disc, and shows the velocity distribution close to the disc.

Figure 4:
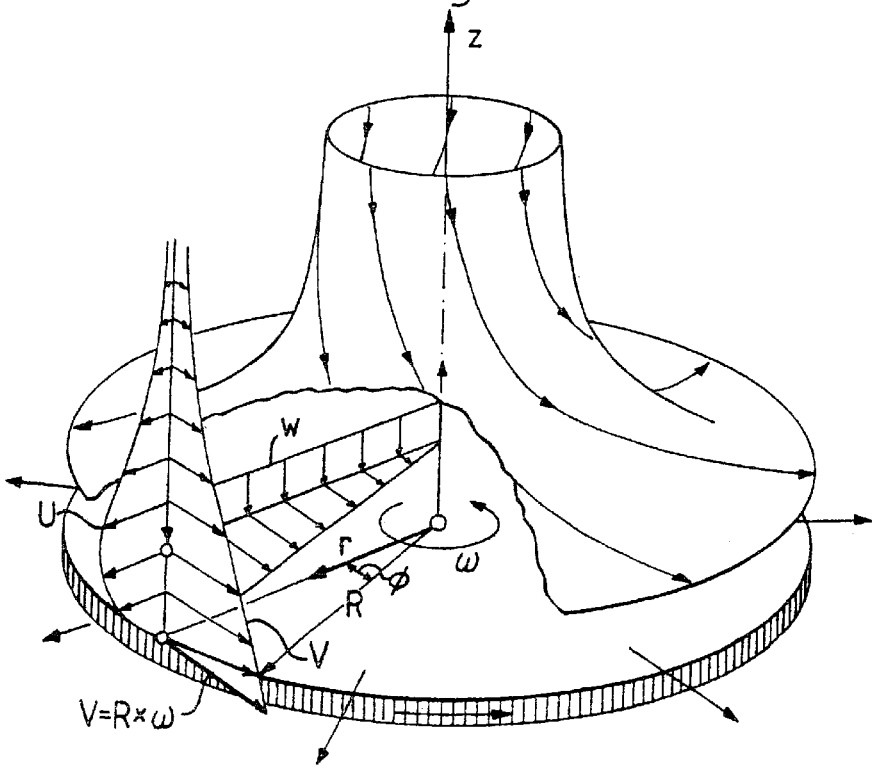
FIG. 4 illustrates a corresponding flow pattern of the disc when the fluid is delivered to the center or the disc.
Figure 5:
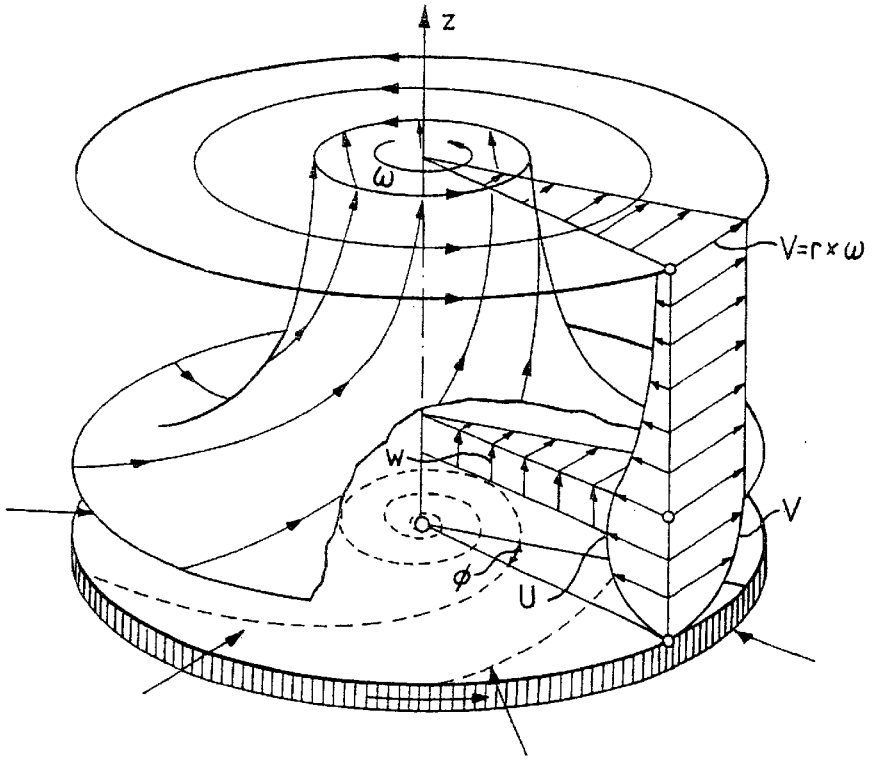
FIG. 5 illustrates a corresponding flow pattern when the fluid is delivered to the periphery of the disc with the fluid in full rotation.

The flow pattern, or flow field, has the appearance shown in FIGS. 4 and 5, wherein FIG. 4 illustrates the occurrence when the fluid is delivered to the. center of the disc, while FIG. 5 is an illustration which shows the fluid delivered to the periphery of the disc with the fluid already in full rotation and flowing towards the center of the disc, similar to the embodiment shown in FIG. 1.

Figure 6:
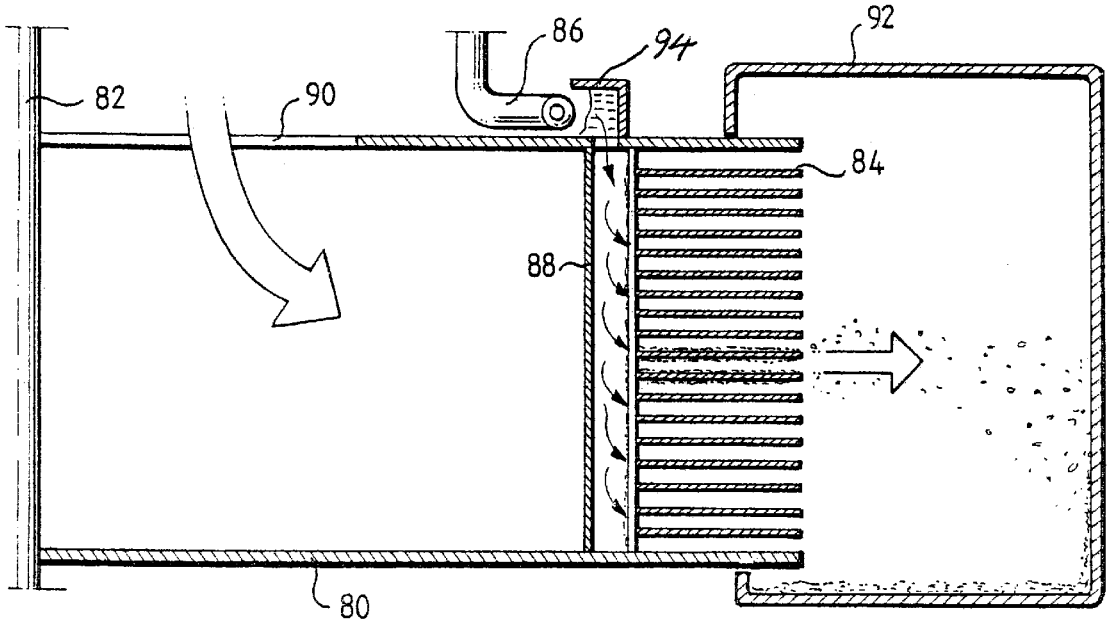
FIG. 6 is a sectional view of an apparatus for transferring mass in accordance with the principles of the invention.

FIG. 6 illustrates a mass transfer apparatus, for instance an apparatus for transferring steam or water vapor to or from a salt solution from an air flow.

Arranged in a rotatable housing 80 having a center axis 82, is a packet of discs 84 to which a salt solution is delivered with the aid of a stationary delivery pipe 86 from which the salt solution is passed through a circumferential, angle-forming ring 94 and down into several distribution pipes 88 disposed around the housing periphery and rotating together with the housing, the pipes distributing the salt solution over the discs 84. Air is blown into the housing through an opening 90 and over the disc pack 84, wherewith an exchange takes place between the air and the salt solution distributed on the discs. The salt solution leaving the discs is collected in the bottom part of a stationary hood 92, which has, for instance, a spiral configuration and which conducts away the air exiting from the housing 80 and the discs 84, and also the salt solution.

All of the illustrated embodiments of the invention, i.e. embodiments having planar surfaces and rotating cylindrical surfaces, enable a more compact contact body to be produced whose transfer performance is achieved more by speed than by surface size. Because the flows are delivered in parallel, a large volumetric flow can be distributed over an appropriate number of discs to the extent permitted by the flow capacity of the boundary layer, so that the flow is adapted optimally, to the best possible effect, to provide the best transfer ability or transfer effect with the rotation-mechanical conditions that prevail.

Although the transfer of heat or mass has been described in the aforegoing as the transfer of heat between two fluids, it will be obvious that the inventive concept can also be applied to other forms of transfer such as mass transfer as mentioned above with reference to FIG. 6. The rotating cylindrical surface or disc surface may, for instance, comprise a catalyst or be provided with a substance, liquid or solid or like consistency, which has a chemical/physical or some other effect on one or more components of the liquid passing through the gap. The good transfer effect that prevails in the gap close to the disc surface or the cylindrical surfaces then facilitates the transfer of the components from the fluid to the surface, or vice versa.

It will also be obvious that the illustrated and described exemplifying embodiments of the invention do not limit the scope of the invention and that modifications and changes can be made within the scope of the following claims.

I claim:

1. A method for effecting mass transfer between at least two flowing media using a device having a plurality of discs which are vertically spaced relative to one another so as to form fluid passageways therebetween and wherein the discs have generally planar upper surfaces and are rotatable about a center vertical axis of a housing of the device and wherein a medium distribution means is mounted so as to convey a first medium toward the fluid passageways between the spaced discs, the method comprising the steps of:

introducing the first medium through the distribution means as the plurality of discs are rotated so as to convey the first medium onto the upper surfaces of the rotating discs to thereby create a plurality of parallel boundary layer flows, introducing a second medium in the form of a gas into said housing so as to flow outwardly relative to the central axis of the housing past the distribution means and into said fluid passageways defined between the plurality of discs to thereby effect a mass transfer between the first and second mediums moving through the fluid passageways defined between the spaced discs, and collecting the first medium as the first medium is discharged from the upper surfaces of the rotating discs.

2. The method of claim 1 in which said first fluid medium is a liquid salt solution.

3. A method of effecting mass transfer between two media using a device having a plurality of discs having planar surfaces which are vertically spaced relative to one another so as to form fluid passageways therebetween and wherein the discs are rotatable about a center vertical axis of a housing of the device, the method comprising the steps of:

rotating the plurality of discs about the center vertical axis of the housing;

introducing a first medium onto the planar surfaces of the plurality of vertically spaced discs so as to form boundary layer parallel flows adjacent the planar surfaces of the plurality of discs which flows are directed horizontally outwardly relative to the center vertical axis of the housing toward a collection area;

introducing a second medium into said housing so as to flow radially outwardly relative to the center vertical axis of the housing through the fluid passageways defined between the vertically spaced discs as they are rotated to thereby communicate the second medium with the boundary layer parallel flows of the first medium to thereby effect a mass transfer between the first and second media.

4. The method of claim 3 including the additional step of introducing the second medium into the housing so as to flow from adjacent the center axis of the housing outwardly through the fluid passageways formed between the plurality of vertically spaced discs.

5. The method of claim 3 including the additional step of introducing the first medium into a distribution means which rotates with the housing and which distribution means is spaced inwardly of the housing toward the center axis thereof with respect to the plurality of vertically spaced discs so that the first medium is conveyed from the rotating distribution means onto the planar surfaces of the plurality of vertically spaced discs.

6. The method claim 5 in which the first medium is a salt solution and the second medium is a gas.

7. The method of claim 5 in which the second medium is selected from a group consisting of steam and water vapor.

* * * * *